US010133292B1

(12) United States Patent
Summers et al.

(10) Patent No.: US 10,133,292 B1
(45) Date of Patent: Nov. 20, 2018

(54) LOW SUPPLY CURRENT MIRROR

(71) Applicant: Cadence Design Systems, Inc., San Jose, CA (US)

(72) Inventors: Mark Alan Summers, Cary, NC (US); Scott David Huss, Cary, NC (US)

(73) Assignee: CADENCE DESIGN SYSTEMS, INC., San Jose, CA (US)

( * ) Notice: Subject to any disclaimer, the term of this patent is extended or adjusted under 35 U.S.C. 154(b) by 0 days.

(21) Appl. No.: 15/191,678

(22) Filed: Jun. 24, 2016

(51) Int. Cl.
*G05F 3/26* (2006.01)

(52) U.S. Cl.
CPC ..... *G05F 3/26* (2013.01); *G05F 3/262* (2013.01)

(58) Field of Classification Search
CPC ..... G05F 3/26; G05F 3/267; G05F 3/262
See application file for complete search history.

(56) References Cited

U.S. PATENT DOCUMENTS 5,545,977 A * 8/1996 Yamada ..... G05F 3/245 323/313
5,867,067 A * 2/1999 Moriarty, Jr. ..... G05F 3/262 323/315
7,816,897 B2 * 10/2010 Illegems ..... G05F 3/262 323/274
8,487,692 B1 * 7/2013 Chen ..... H03K 17/164 327/538
9,112,484 B1 * 8/2015 Clark ..... H03K 3/0315
9,667,134 B2 * 5/2017 Qaiyum ..... H02M 1/36
2008/0309320 A1 * 12/2008 Chu ..... G01R 19/16538 324/119
2009/0085550 A1 * 4/2009 Ide ..... G05F 3/16 323/315
2009/0167263 A1 * 7/2009 Wang ..... G05F 3/262 323/266
2010/0127687 A1 * 5/2010 Boas ..... G05F 3/16 323/311
2010/0289936 A1 * 11/2010 Kimura ..... H03K 19/018521 348/308
2011/0121809 A1 * 5/2011 Camacho Galeano ..... G05F 3/262 323/313
2012/0105046 A1 * 5/2012 Marshall ..... G05F 3/262 323/315
2013/0088286 A1 * 4/2013 Nadimpalli ..... G05F 3/02 327/541
2015/0054586 A1 * 2/2015 Jaffari ..... H03F 1/0205 330/296
2015/0207513 A1 * 7/2015 Tsunoda ..... H03L 7/0895 327/66
2015/0241902 A1 * 8/2015 Chang ..... H01L 27/0617 323/313
2016/0274614 A1 * 9/2016 Tang ..... G05F 3/262
2016/0349785 A1 * 12/2016 Ciubotaru ..... G05F 3/262
2017/0185097 A1 * 6/2017 Kundu ..... G05F 3/262

* cited by examiner

*Primary Examiner* — Fred E Finch, III
*Assistant Examiner* — Demetries A Gibson
(74) *Attorney, Agent, or Firm* — Hunton Andrews Kurth LLP

(57) ABSTRACT

Systems disclosed herein provide for a low-noise current mirror operable under low power supply requirements. Embodiments of the systems provide for a low input current path and a high input current path, wherein the current in the low current input path sees a higher voltage and the current in the high input current path sees a lower voltage. Embodiments of the system also provide for a cascode transistor in the high input current path.

20 Claims, 4 Drawing Sheets

$V_{DD}$
$V_{PB}$
101
$V_3$
$I_{IN1}$
$V_{PC}$
105
$V_1$
102
$V_{SS}$
100
104
$V_L$
$V_2$
$I_{OUT1}$
103

$V_{DD}$
$V_{PB}$
101
$I_{IN1}$
$V_1$
102
$V_{SS}$
100
104
$V_L$
$V_2$
$I_{OUT1}$
103

LOW SUPPLY CURRENT MIRROR

TECHNICAL FIELD

The present application relates to systems for operating a current mirror under low power supply requirements.

BACKGROUND

A current mirror, as its name suggests, is utilized in integrated circuits to mirror (e.g., copy) a reference current flowing through one active device (e.g., transistor) in another active device (e.g., another transistor). The current mirror is intended to maintain the output current (e.g., the mirrored reference current) at a constant level regardless of load changes at the other active device. Further, the current being mirrored can be a direct current ("DC") or an alternating current ("AC"). Current mirrors are generally utilized in integrated circuits to provide bias currents and/or active loads.

However, current mirrors are still susceptible to errors. For example, in many current mirrors, the current source transistor (e.g., the transistor utilized to generate the reference current) has low output impedance, leaving the current source transistor more sensitive to noise in the integrated circuit. For example, the current source transistor is less able to reject noise from a power supply when the output impedance is low. Further, the low output impedance also leads to a lower power supply rejection ratio ("PSRR"). The PSRR is a ratio of the change in supply voltage to the change in output voltage. As such, as the power supply modulates (e.g., due to noise), so will the $V_{DS}$ across the current source transistor and, therefore, the current generated by the current source transistor. As the reference current modulates, it becomes more difficult to effectively maintain a desired ratio of the output current to the reference current.

Further, the power requirements for the current mirror transistor and the output current transistor also affect the performance of the current source transistor. For example, both of the current mirror transistor and the output current transistor have to operate in the saturated region in order to mirror the reference current at the output current transistor. Therefore, the $V_{DS}$ of each transistor has to be greater than the difference between the $V_{GS}$ and $V_T$ of the transistor (e.g., $V_{DSat}>V_{GS}-V_T$). As the $V_{DS}$ for the transistors modulates, so will the $V_{DS}$ across the current source transistor, which, as stated above, makes it more difficult to maintain the desired ratio of the output current to the reference current.

In order to address the aforementioned effects of low output impedance, many current mirrors include a cascode transistor at the drain node of the current source transistor. The cascode transistor is essentially a gain amplifier that amplifies (e.g., multiplies) the low output impedance at the drain node of the current source transistor, resulting in a higher output impedance. Further, the cascode transistor disjoins the dependency of the $V_{DS}$ voltage across the current source transistor from (i) the power supply and (ii) the $V_{DS}$ voltage across the current mirror transistor. Therefore, any voltage modulations (e.g., due to noise or otherwise) from the power supply or the current mirror transistor would not affect the $V_{DS}$ voltage across the current source transistor, thereby maintaining the desired ratio of the output current to the reference current. However, in circuit designs with low power supply requirements, there may not be enough headroom (e.g., remaining voltage) to include the cascode transistor.

Noise in the system can be further mitigated by increasing the $V_{DSat}$ of the current mirror transistor and the output current transistor. However, as the $V_{DSat}$ of the current mirror and output current transistors are increased, less headroom will be available for the current source transistor. Further, if (i) the $V_{DS}$ across the transistors (e.g., current mirror and output current) are high and (ii) the reference current is also high, the reference current will likely compress. As the reference current compresses, it will again become more difficult to effectively maintain the desired ratio of the output current to the reference current.

Accordingly, there is a need for a low-noise current mirror to operate under low power supply requirements.

DESCRIPTION OF EMBODIMENTS

Figure 1B:
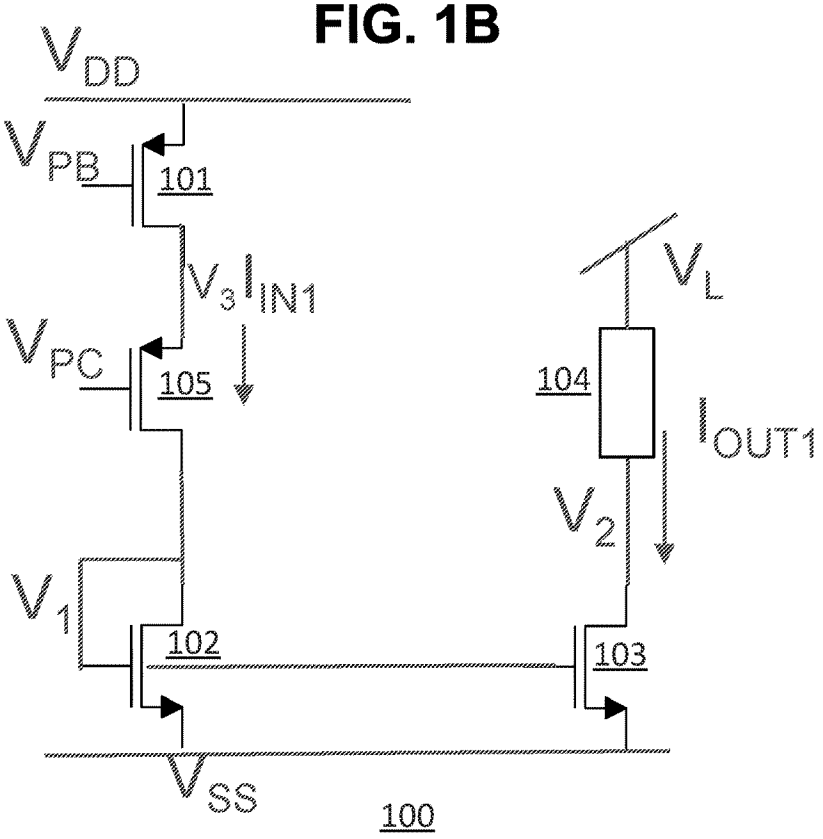
FIG. 1B illustrates a conventional current mirror with a cascode transistor.

The following description of embodiments provides non-limiting representative examples referencing numerals to particularly describe features and teachings of different aspects of the invention. The embodiments described should be recognized as capable of implementation separately, or in combination, with other embodiments from the description of the embodiments. A person of ordinary skill in the art reviewing the description of embodiments should be able to learn and understand the different described aspects of the invention. The description of embodiments should facilitate understanding of the invention to such an extent that other implementations, not specifically covered but within the knowledge of a person of skill in the art having read the description of embodiments, would be understood to be consistent with an application of the invention.

One aspect of the present disclosure is to provide systems for operating a current mirror under low power supply requirements. The systems herein address at least one of the problems discussed above. Accordingly, a current mirror system with parallel input current paths is provided.

According to an embodiment, a current mirror system includes: a first current source transistor, wherein the first current source transistor includes a channel width of 1 $W_{UNIT}$, wherein the $W_{UNIT}$ corresponds to a channel width of a unit transistor; a second current source transistor, wherein the second current source transistor includes a channel width of $(N-1)\times W_{UNIT}$, wherein N is an integer that corresponds to a desired width of a current source transistor; a first current mirror transistor, wherein the first current mirror transistor includes a channel width of $(M)\times W_{UNIT}$ and a channel length of $(N)\times L_{UNIT}$, wherein the $L_{UNIT}$ corresponds to a channel length of the unit transistor, wherein M is an integer that corresponds to a desired width of a current mirror transistor; a second current mirror transistor, wherein the second current mirror transistor includes a channel width of $(M)\times W_{UNIT}$ and a channel length of $(P-1)\times L_{UNIT}$, wherein P is an integer that corresponds to a desired length of the current mirror transistor; and an output current transistor, wherein the output current transistor includes a channel width of $K\times(M)\times W_{UNIT}$ and a channel length of $(P-1)\times L_{UNIT}$, wherein K is a current gain coefficient.

According to another embodiment, a current mirror system includes: a first current source transistor, wherein the first current source transistor is configured to generate a first current that is (1/N) of a total generated current, wherein N is an integer greater than zero; a second current source transistor, wherein the second current source transistor is configured to generate a second current that is ((N−1)/N) of the total generated current; a first current mirror transistor, wherein the first current mirror transistor is configured to receive the first current; a second current mirror transistor, wherein the second current mirror transistor is configured to receive a sum of the first and second currents; and an output current transistor, wherein the output current transistor is configured to receive an output current, wherein the output current is based on the sum of the first and second currents at the second current mirror transistor.

Figure 1A:
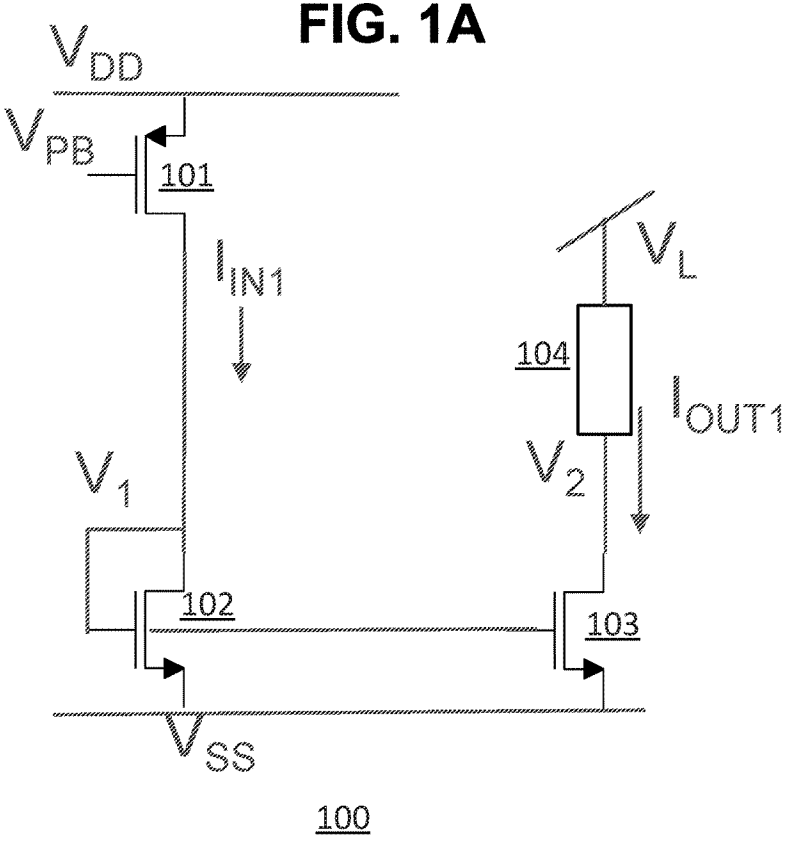
FIG. 1A illustrates a conventional current mirror.

FIG. 1A illustrates a conventional current mirror. Current mirror 100 includes a current source transistor 101, a current mirror transistor 102, an output current transistor 103, and a load 104. As depicted in FIG. 1A, the current source transistor 101 is a PMOS transistor. In an embodiment, the current source transistor 101 includes a channel width of $N\times W_{UNIT}$ and a channel length of $Y\times L_{UNIT}$, wherein $W_{UNIT}$ corresponds to the channel width of a unit transistor, N is an arbitrary integer that corresponds to a desired width of a current source transistor, $L_{UNIT}$ corresponds to a channel length of the unit transistor, and Y is an arbitrary integer that corresponds to a desired length of a current source transistor. In an embodiment, the desired length of the current source transistor 101 is usually set to a long length in order to improve (i) matching between the input current and the output current and (ii) the output impedance of the current source transistor 101.

Further, the source node of the current source transistor 101 is connected to a positive power supply $V_{DD}$, and the drain node of the current source transistor 101 is connected to the drain node of the current mirror transistor 102. Further, the gate node of the current source transistor 101 receives a voltage $V_{PB}$. Voltage $V_{PB}$ is the $V_{GS}$ of the current source transistor 101. Therefore, once the voltage $V_{GS}$ is at $V_{PB}$, the current source transistor 101 will turn on. As further depicted in FIG. 1A, the current source transistor 101 generates an input current $I_{IN1}$.

Further, as depicted in the figure, the current mirror transistor 102 is a NMOS transistor. In an embodiment, the current mirror transistor 102 includes a channel width of $M\times W_{UNIT}$ and a channel length of $P\times L_{UNIT}$, wherein M is an arbitrary integer that corresponds to a desired width of a current mirror transistor and P is an arbitrary integer that corresponds to a desired length of a current mirror transistor. Further, the source node of the current mirror transistor 102 is connected to a negative power supply $V_{SS}$. Further, the gate node of the current mirror transistor 102 is connected to the drain node of the current mirror transistor 102 via a short. The gate node of the current mirror transistor 102 receives a voltage $V_1$. Voltage $V_1$ is the $V_{GS}$ of the current mirror transistor 102. Therefore, once the voltage $V_{GS}$ is at $V_1$, the current mirror transistor 102 will turn on.

Further, similar to the current mirror transistor 102, the output current transistor 103 is also a NMOS transistor. In an embodiment, the output current transistor 103 includes a channel width of $K\times M\times W_{UNIT}$ and a channel length of $P\times L_{UNIT}$, wherein K is the current gain coefficient. Further, the source node of the output current transistor 103 is also connected to a negative power supply $V_{SS}$. The drain node of the output current transistor 103 is connected to a first end of the load 104. Further, the drain node of the output current transistor 103 is at a voltage $V_2$. Further, the gate node of the output current transistor 103 receives the voltage $V_1$, which is also the $V_{GS}$ of the output current transistor 103. Therefore, once the voltage $V_{GS}$ is at $V_1$, the output current transistor 103 will turn on. In an embodiment, the output current transistor 103 establishes an output current $I_{OUT1}$, which is a ratio of the input current $I_{IN1}$ (e.g., $K\times I_{IN1}$). In other words, depending on the current gain coefficient K, the current mirror 100 can either amplify, replicate, or reduce the input current $I_{IN1}$. Specifically, the output current $I_{OUT1}$ can be modified by increasing or decreasing the channel width of the output current transistor 103 by the factor K. However, other than the channel widths, it is important that the other characteristics of the current mirror transistor 102 and the output current transistor 103 are equivalent (e.g., channel length, $V_{GS}$, etc.) in order for the current mirror 100 to properly operate.

In an embodiment, the output current $I_{OUT1}$ originates from the load 104. In an embodiment, the load 104 could be one of: (i) a resistor, (ii) another current mirror, or (iii) any other circuit that needs to draw a current from a current source. Further, the load 104 is connected to a voltage source $V_L$ at its second end. In an embodiment, the voltage source $V_L$ is set high enough such that the voltage $V_2$ is at a sufficient level for the output current transistor 103 to operate.

Further, as discussed above, in order for the current mirror 100 to mirror the input current $I_{IN1}$ at the output current transistor 103, both of the current mirror transistor 102 and the output current transistor 103 have to operate in the saturated region (e.g., $V_{DSat}>V_{GS}-V_T$). Therefore, the voltage $V_1$ (e.g., the $V_{GS}$ of both of the current mirror transistor 102 and the output current transistor 103) will be comprised of a threshold voltage $V_T$ (e.g., minimum voltage required to operate the transistor) and the overdrive voltage $V_{DSat}$ (minimum voltage required to operate the transistor in the saturated region). Similarly, the voltage $V_2$ has to be greater than the overdrive voltage $V_{DSat}$ of the output current transistor 103 for it to operate in the saturated region. $V_1$ will likely require a large portion of the power being supplied by the positive power supply $V_{DD}$ and the negative power supply $V_{SS}$ during the operation of the current mirror 100. Further, assuming the current source transistor 101 has low impedance, the voltage $V_{PB}$ will vary at the drain node of the current source transistor 101 with any modulation in the voltage $V_1$. Therefore, as the overdrive voltage $V_{DSat}$ of the current mirror transistor 102 is increased, less headroom will be available for the current source transistor 101 to properly operate. Further, if the current mirror transistor 102 is at a high enough $V_{DS}$ (e.g., due to a high threshold voltage $V_T$ and a high overdrive voltage $V_{DSat}$) and the current generated at the current source transistor 101 (i.e., input current $I_{IN1}$) is also high, the generated input current $I_{IN1}$ will likely begin to compress and, therefore, the K factor ratio for the output current $I_{OUT1}$ will no longer hold. Further, as also discussed above, because the current source transistor 101 has low impedance, the current source transistor 101 is also associated with a lower PSRR. Accordingly, as the power supply $V_{DD}$ modulates (e.g., due to noise), so will the voltage $V_{PB}$ and, therefore, the input current $I_{IN1}$ generated by the current source transistor 101.

FIG. 1B illustrates a conventional current mirror with a cascode transistor. As depicted in FIG. 1B, the current mirror 100 includes a cascode transistor 105. In an embodiment, the cascode transistor 105 is a PMOS transistor. In an embodiment, the cascode transistor 105 includes a channel width of $N \times W_{UNIT}$ and a channel length of $L_{UNIT}$. In another embodiment, the channel length of the cascode transistor 105 can be set to another length. Generally, the channel length is set low in order to keep the overdrive voltage $V_{DSat}$ and area of the cascode transistor 105 low. Further, (i) the source node of the cascode transistor 105 is connected to the drain node of the current source transistor 101 and (ii) the drain node of the cascode transistor 105 is connected to the drain node of the current mirror transistor 102. Further, the gate node of the cascode transistor 105 receives a voltage $V_{PC}$. The voltage $V_{PC}$ is the $V_{GS}$ of the cascode transistor 105. The cascode transistor 105 acts as a gain amplifier. Specifically, the cascode transistor 105 amplifies the low output impedance at the drain node of the current source transistor 101, resulting in a higher output impedance. Therefore, as the voltage $V_1$ moves (e.g., due to noise, increase in $V_{DSat}$, large $V_T$, etc.) at the drain node of the cascode transistor 105, the voltage $V_3$ at the source node of the cascode transistor 105 only has to move a small amount to compensate for the movement of $V_1$. Further, the cascode transistor 105 also operates in the saturated region (e.g., $V_{DSat} > V_{GS} - V_T$). Therefore, the current going through the cascode transistor 105 (e.g., the input current $I_{IN1}$) will be independent of the $V_{DS}$ across the cascode transistor 105. As such, the voltage $V_{PC}$ at the gate node of the cascode transistor 105 does not have to move very much in order compensate for the movement of the voltage $V_1$, and, therefore, any changes in the $V_{DS}$ of the cascode transistor 105, thereby isolating the $V_{DS}$ of the current source transistor 101 from changes at $V_1$ as well as $V_{DD}$. Further, with a constant $V_{DS}$ across the current source transistor 101, the input current $I_{IN1}$ will also remain fixed. As such, the output current $I_{OUT1}$, which is meant to be a ratio of the input current $I_{IN1}$ (e.g., $K \times I_{IN1}$), will also be maintained with some consistency. Further, because the current mirror 100 will be less sensitive to noise emanating from the power supply $V_{DD}$, the PSRR will also be higher.

However, as mentioned above, in circuit designs with low power supply requirements (e.g., $V_{DD} < 1$ V), there may not be enough headroom to include the cascode transistor 105. In lieu of the cascode transistor 105, noise can also be mitigated by increasing the $V_{DSat}$ of the current mirror transistor 102 and the output current transistor 103. In addition, the PSRR of the current mirror 100 can be improved by decreasing the $V_{DSat}$ of the current source transistor 101 (e.g., since the difference between $V_{DS}$ and $V_{DSat}$ will be higher). However, with a finite power supply, any increase in the $V_{DSat}$ voltages will likely lead to less headroom for the current source transistor 101. Further, decreasing the $V_{DSat}$ of the current source transistor 101 will likely leave the device more susceptible to noise and, thus, result in worse matching between the input current $I_{IN1}$ and the output current $I_{OUT1}$.

Further, as previously discussed, current compression can result if the generated input current $I_{IN1}$ is high and the $V_{DS}$ of current mirror transistors 102 and 103 is also high (e.g., due to the higher overdrive voltage $V_{DSat}$). If the input current $I_{IN1}$ is compressed, the desired ratio of the output current $I_{OUT1}$ to the input current (e.g., K) will likely not hold, thereby defeating the purpose of utilizing a current mirror.

Figure 2:
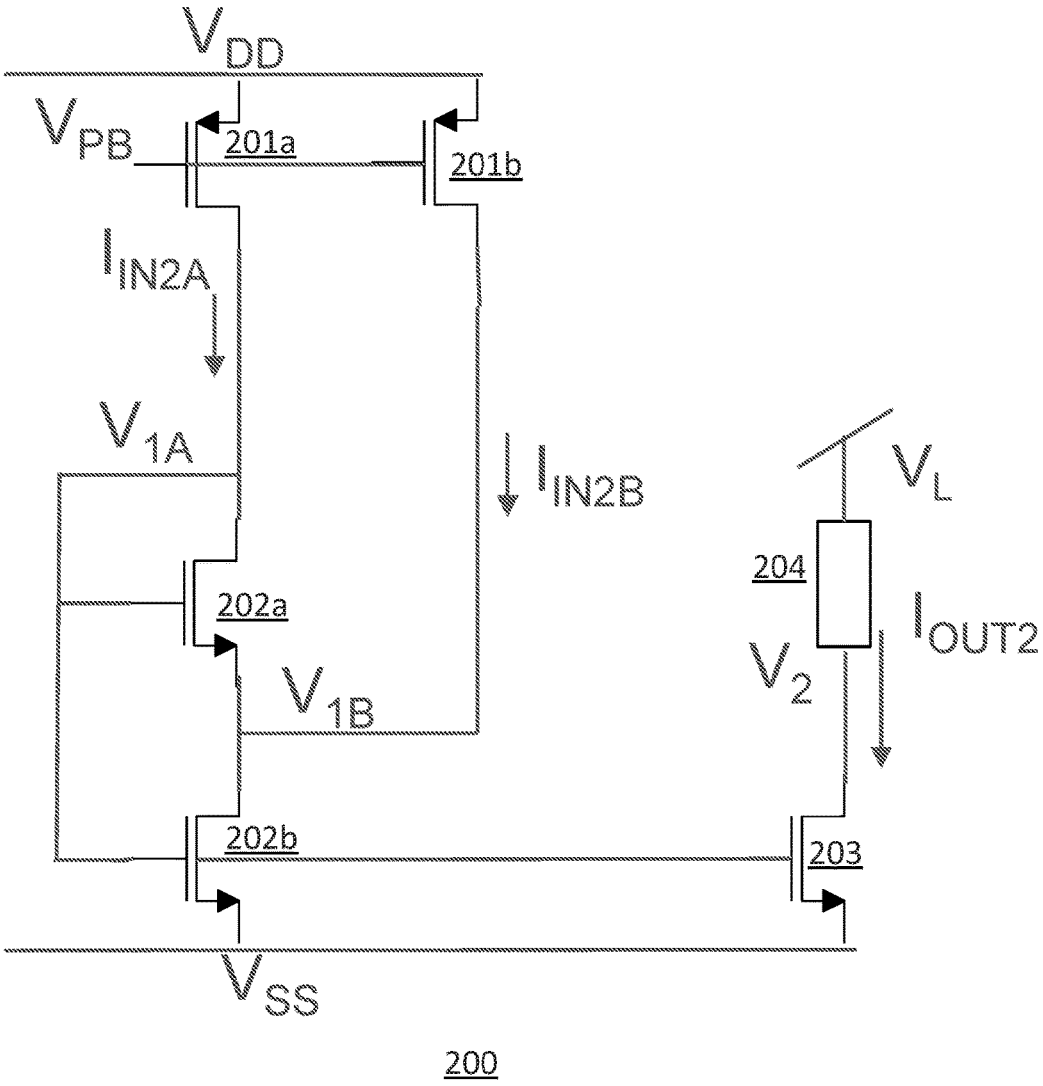
FIG. 2 illustrates a low supply current mirror in accordance with an example embodiment of the present invention.

FIG. 2 illustrates a low supply current mirror in accordance with an example embodiment of the present invention. As depicted in FIG. 2, current mirror 200 includes a first current source transistor 201*a*, a second current source transistor 201*b*, a first current mirror transistor 202*a*, a second current mirror transistor 202*b*, an output current transistor 203, and a load 204.

In an embodiment, the first current source transistor 201*a* and the second current source transistor 201*b* are PMOS transistors. In an embodiment, the first current source transistor 201*a* includes a channel width of 1 $W_{UNIT}$ and the second current source transistor 201*b* includes a channel width of $(N-1) \times W_{UNIT}$. Further, in an embodiment, the channel lengths of the first and second current source transistors 201*a* and 201*b* are both equal to $Y \times L_{UNIT}$. At equal channel lengths, the current matching between the input current and the output current improves. In another embodiment, the channel lengths of the first and second current source transistors 201*a* and 201*b* can be of different lengths. In an embodiment, each of the channel lengths is set to a long length, which also improves the current matching as well as reduces noise. In another embodiment, however, each of the channel lengths can be set to a short length. In an embodiment, the current mirror 200 includes two current input paths (e.g., $I_{IN2A}$ and $I_{IN2B}$). In an embodiment, (1/N) of the total generated input current will be generated by the first current source transistor 201*a* (e.g., $I_{IN2A}$) and ((N−1)/N) of the total generated input current will be generated by the second current source transistor 201*b* (e.g., $I_{IN2B}$).

In an embodiment, the source node of each of the first and second current source transistors 201*a* and 201*b* is connected to the positive power supply $V_{DD}$. Further, the gate node of each of the first and second current source transistors 201*a* and 201*b* receives a voltage $V_{PB}$. In an embodiment, the voltage $V_{PB}$ is the $V_{GS}$ of the first and second current source transistors 201*a* and 201*b*. Further, as depicted in FIG. 2, the drain node of the first current source transistor 201*a* is connected to the drain node of the first current mirror transistor 202*a*. Further, the drain node of the second current source transistor 201*b* is connected to (i) the source node of the first current mirror transistor 202*a* and (ii) the drain node of the second current mirror transistor 202*b*.

In an embodiment, the first and second current mirror transistors 202*a* and 202*b* are NMOS transistors. Further, the first current mirror transistor 202*a* includes a channel width of $M \times W_{UNIT}$ and a channel length of $N \times L_{UNIT}$. In an embodiment, the channel length of the first current mirror transistor 202*a* is scaled by N in order to compensate for the smaller input current $I_{IN2A}$ (e.g., 1/N of the total generated input current) flowing through the first current mirror transistor 202*a*. Further, the second current mirror transistor 202*b* also includes a channel width of $M \times W_{UNIT}$ but includes a channel length of $(P-1) \times L_{UNIT}$. In an embodiment, the source node of the first current mirror transistor 202*a* is connected to the drain node of the second current mirror transistor 202*b*. Further, the source node of the second current mirror transistor 202*b* is connected to a negative power supply $V_{SS}$. Further, the gate nodes of the first and second current mirror transistors 202*a* and 202*b* are connected to the drain node of the current mirror transistor 202*a* via a short. In an embodiment, the gate nodes of the first and second current mirror transistors 202*a* and 202*b* receive a voltage $V_{1A}$. In an embodiment, the voltage $V_{1A}$ is the $V_{GS}$ of the first and second current mirror transistors 202*a* and 202*b*. Further, as depicted in FIG. 2, the sum of the input currents $I_{IN2A}$ and $I_{IN2B}$ flows through the second current mirror transistor 202*b*.

Further, in an embodiment, similar to the first and second current mirror transistors 202*a* and 202*b*, the output current transistor 203 is also a NMOS transistor. In an embodiment, the output current transistor 203 includes a channel width of $K \times M \times W_{UNIT}$ and a channel length of $P \times L_{UNIT}$. Further, the source node of the output current transistor 203 is also connected to the negative power supply $V_{SS}$. In an embodiment, the drain node of the output current transistor 203 is connected to a first end of the load 204. Further, the gate node of the output current transistor 203 also receives the voltage $V_{1A}$. In an embodiment, the output current transistor 203 establishes an output current $I_{OUT2}$, which is a ratio of the sum of the input currents $I_{IN2A}$ and $I_{IN2B}$ (e.g., $K \times (I_{IN2A} + I_{IN2B})$). In other words, depending on the current gain coefficient K, the current mirror 200 can amplify, replicate, or reduce the sum of the input currents $I_{IN2A}$ and $I_{IN2B}$. Specifically, the output current $I_{OUT2}$ can be modified by increasing or decreasing the channel width of the output current transistor 203 by the factor K.

In an embodiment, the output current $I_{OUT2}$ originates from the load 204. In an embodiment, the load 204 could be one of: (i) a resistor, (ii) another current mirror, or (iii) any other circuit that needs to draw a current from a current source. Further, the load 204 is connected to a voltage source $V_L$ at its second end. In an embodiment, voltage source $V_L$ could be set to any arbitrary voltage.

In an embodiment, duplicates of the output current $I_{OUT2}$ can be generated with additional output current transistors connected in parallel with the output current transistor 203. In an embodiment, in order to generate duplicates of the output current $I_{OUT2}$, each of the additional output current transistors has to include the same transistor characteristics as the output current transistor 203 (e.g., same transistor type, channel length, channel width, $V_{GS}$, etc.). As such, the additional output current transistors (not shown) are also NMOS transistors. Further, in an embodiment, each of the additional output current transistors is connected to: (i) the negative power supply $V_{SS}$ at its source node and (ii) the load 204 at its drain node. In another embodiment, the additional output transistors can be connected a plurality of other loads as well. Further, in an embodiment, similar to the output current transistor 203, each of the gate nodes of the additional output transistors receives the voltage $V_{1A}$. In an embodiment, each of the additional output current transistors can be used to provide current for the same device. For example, the output current transistor 203 and the additional output current transistors can provide a total current of $(A+1) \times I_{OUT2}$ to the device, wherein A corresponds to a number of additional output currents transistors. In another embodiment, the total current from the output current transistor 203 and the additional output current transistors can also be provided to a plurality of different devices.

In an embodiment, the input current $I_{IN2A}$ drives the drain node of the first current mirror transistor 202*a*. In an embodiment, the input current $I_{IN2A}$ flows through the series combination of the first current mirror transistor 202*a* and the second current mirror transistor 202*b*. Further, as depicted in FIG. 2, the input current $I_{IN2B}$ drives: (i) the source node of the first current mirror transistor 202*a* and (ii) the drain node of the second current mirror transistor 202*b*. In other words, the input current $I_{IN2B}$ drives the midpoint of the series combination of the first current mirror transistor 202*a* and the second current mirror transistor 202*b*. Further, in an embodiment, the input current $I_{IN2B}$ also flows through the second current mirror transistor 202*b*.

In an embodiment, the first current mirror transistor 202*a* operates in the saturated region (e.g., $V_{DSat} > V_{GS} - V_T$). In an embodiment, the overdrive voltage $V_{DSat}$ of the first current mirror transistor 202*a* can be increased in order to mitigate the effect of noise on the first current mirror transistor 202*a*. As such, the input current $I_{IN2A}$ will be driving into a high voltage (e.g., $V_{1A}$). Further, in an embodiment, similar to the current source transistor 101 of FIGS. 1A and 1B, the first current source transistor 201*a* also has low impedance. Therefore, the input current $I_{IN2A}$ of the first current source transistor 201*a* can still be affected by changes at: (i) the positive power supply $V_{DD}$ (e.g., due to noise or otherwise) and (ii) the voltage $V_{1A}$ (e.g., due to noise, increase in $V_{DSat}$, large $V_T$, etc.). However, because the input current $I_{IN2A}$ is only (1/N) of the total generated input current, only (1/N) of the total generated input current will be subject to the current errors.

In an embodiment, there is no $V_T$ voltage at the source node of the first current mirror transistor 202*a* or the drain node of the second current mirror transistor 202*b* (e.g., the nodes that the input current $I_{IN2B}$ is driving into). Therefore, $V_{1B}$ will be less than $V_{1A}$ by at least the $V_T$ of the first current mirror transistor 202*a*. In an embodiment, $V_{1B}$ is essentially equivalent to the $V_{DS}$ of the second current mirror transistor 202*b*. However, unlike the first current mirror transistor 202*a*, which is operating in the saturated region (e.g., $V_{DSat} > V_{GS} - V_T$), the $V_{DS}$ across the second current mirror transistor 202*b* is less than the difference between the voltage $V_{GS}$ (e.g., $V_{1A}$) and the voltage $V_T$ of the second current mirror transistor 202*b* (e.g., $V_{DS} < V_{GS} - V_T$). In an embodiment, the voltage at the drain node of the current mirror transistor 202*b* (e.g., $V_{1B}$) can be less than the voltage at the gate node (e.g., $V_{1A}$) and still operate normally. However, unlike the first current mirror transistor 202*a*, the second current mirror transistor 202*b* is operating in the linear region (e.g., degeneration). In other words, the second current mirror transistor 202*b* acts like a resistor (i.e., the voltage changes linearly as the current changes). In an embodiment, as compared to the input current $I_{IN2A}$, the input current $I_{IN2B}$ is driving into a much lower voltage, e.g., $V_{1B}$. Therefore, most of the total generated input current (e.g., (N−1)/N) will see the much lower voltage (e.g., $V_{1B}$). Accordingly, by splitting up the total generated current into: (i) a low current path seeing higher voltage and (ii) a higher current path seeing lower voltage, the current compression problem associated with the current mirror 100 is resolved. Further, because $V_{1B}$ is at a much lower voltage than $V_{1A}$, there is a greater voltage difference between $V_{PB}$ and $V_{1B}$. Therefore, the $V_{DS}$ of the second current source transistor 201*b* will be much larger than it would have been with the current source transistor 101 in the current mirror 100. In an embodiment, with a higher $V_{DS}$, the percentage that the $V_{DS}$ moves due to current error (e.g., due to noise from the positive power supply $V_{DD}$ or otherwise) is much less than had the $V_{DS}$ been smaller (e.g., as it is with the current source transistor 101). As such, noise from the positive power supply $V_{DD}$ is going to have less of an effect on most of the total generated input current (e.g., $I_{IN2B}$). Therefore, the current mirror 200 will be associated with a higher PSRR. Similarly, noise from the positive power supply $V_{DD}$ and the voltage $V_{1A}$ in the $I_{IN2A}$ current path will have only a "1/N" effect on the total generated input current. As such, the PSRR for the current mirror 200 will be greater than the PSRR for the current mirror 100 by a factor of N.

Figure 3A:
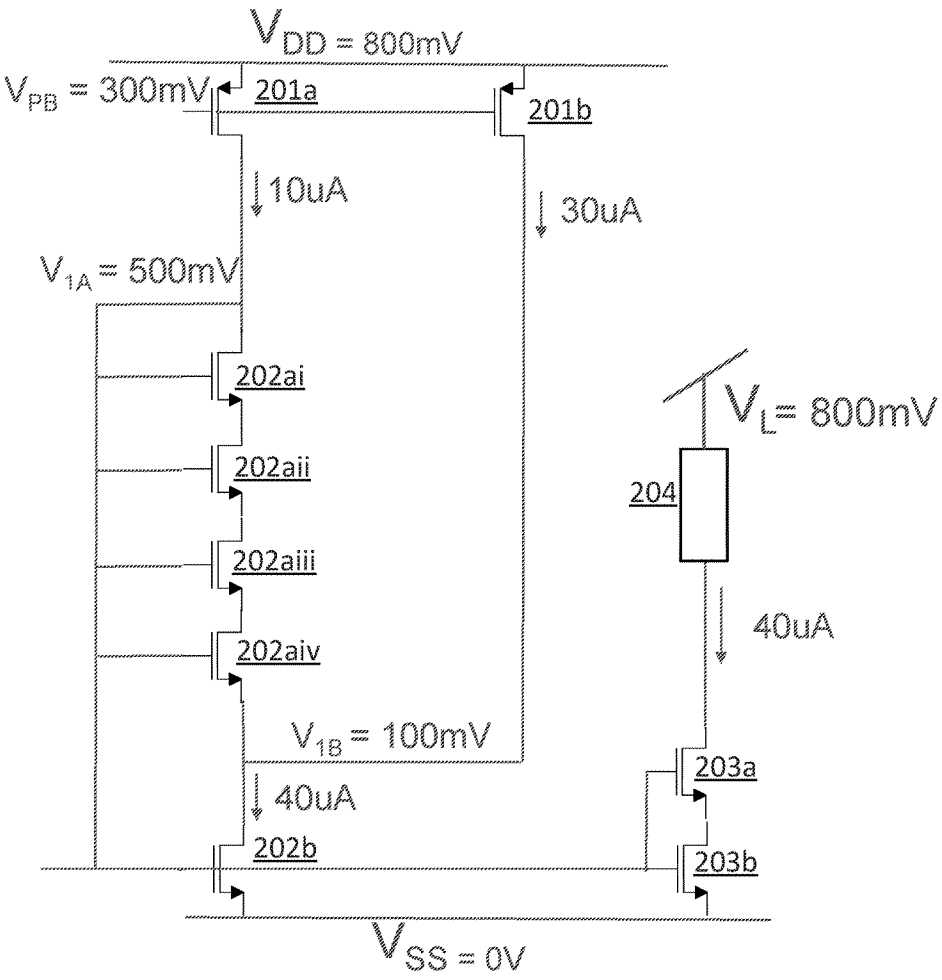
FIG. 3A illustrates a specific example of the low supply current mirror of FIG. 2.
Figure 3B:
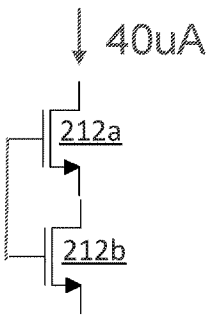
FIG. 3B illustrates an equivalent circuit of the reference current transistors utilized in the low supply current mirror in FIG. 3A.

FIG. 3A illustrates a specific example of the low supply current mirror of FIG. 2. As depicted in FIG. 3A, the positive power supply $V_{DD}$ is set at 800 mV, the negative power supply $V_{SS}$ is set at 0 V (i.e., ground), the voltage $V_{PB}$ is set at 300 mV, the voltage $V_{1A}$ is set at 500 mV, the voltage $V_{1B}$ is set at 100 mV, and the voltage $V_L$ is set at 800 mV. Further, the input current $I_{IN2A}$ is 10 μA and the input current $I_{IN2B}$ is 30 μA. As such, the second current mirror transistor 202*b* receives the combination of input currents $I_{IN2A}$ and $I_{IN2B}$, i.e., 40 μA. Therefore, the generated output current $I_{OUT2}$ is also equivalent to 40 μA. In an embodiment, the first current source transistor 201*a* includes a channel width of 1 μm and a channel length of 0.1 μm. Further, the second current source transistor 201*b* includes a channel width of 3 μm and a channel length of 0.1 μm. In an embodiment, as depicted in FIG. 3A, the first current mirror transistor 202*a* can include a stack of four transistors, e.g., transistors 202*ai*-202*aiv*. In an embodiment, the transistors 202*ai* to 202*aiv* are connected in series. Further, each of the four transistors includes a channel width of 4 μm and a channel length of 0.1 μm. In an embodiment, the second current mirror transistor 202*b* includes a channel width of 4 μm and a channel length of 0.1 μm. In an embodiment, the series combination of the transistors 202*ai*-202*aiv* and the second current mirror transistor 202*b* is equivalent to a stack of two transistors each with a channel width of 4 μm and a channel length of 0.1 μm (see transistors 212*a* and 212*b* of FIG. 3B). Further, the $V_{GS}$ across the transistors 202*ai* to 202*aiv*, which each receive 10 μA, is equivalent to the $V_{GS}$ of a device which (i) includes a channel width of 4 μm and a channel length of 0.1 μm (ii) and receives 40 μA. Therefore, the $V_{GS}$ across the transistors 202*ai* to 202*aiv* is equivalent to the $V_{GS}$ of the second current mirror transistor 202*b*. Further, as depicted in FIG. 3A, transistor 203 can include a stack of two transistors, e.g., transistors 203*a* and 203*b*. In an embodiment, the transistors 203*a* and 203*b* are connected in series. Further, each of the two transistors includes a channel width of 4 μm and a channel length of 0.1 μm. In an embodiment, the device structure of the transistors 203*a* and 203*b* matches the device structure of transistors 212*a* and 212*b* of FIG. 3B (e.g., the equivalent circuit of the series combination of the transistors 202*ai*-202*aiv* and the second current mirror transistor 202*b*). In an embodiment, based on the above transistor specifications (e.g., channel length, channel width, number of stacked devices), it can be deduced that N=4, W=4, P=2, and K=1. In another embodiment, instead of stacking transistors of specific channel lengths and widths, unit transistors can be stacked. In an embodiment, unit transistors include a channel width of 1 μm and a channel length of 0.1 μm. Further, the unit transistors can be (i) connected in series in order to increase the length and (ii) connected in parallel in order to increase the width.

Figure 4:
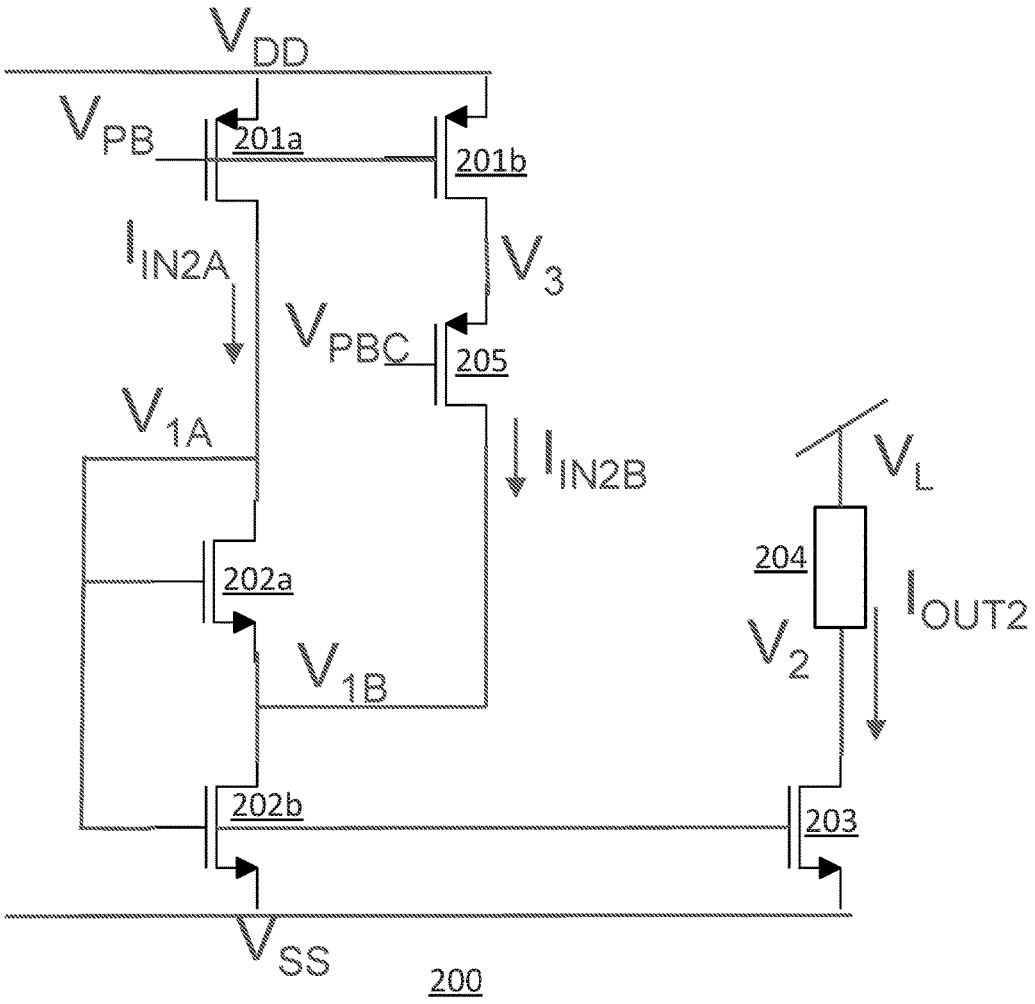
FIG. 4 illustrates another example embodiment of the low supply current mirror.

FIG. 4 illustrates another example embodiment of the low supply current mirror. In an embodiment, the current mirror 200 further includes a cascode transistor 205 in the $I_{IN2B}$ current path. In an embodiment, because there is a greater voltage difference between $V_{PB}$ and $V_{1B}$ in the current mirror 200, there is now enough headroom to include at least one cascode transistor. In an embodiment, the cascode transistor 205 is a PMOS transistor. Further, like the second current source transistor 201*b*, the cascode transistor 205 includes a channel width of $(N-1)\times W_{UNIT}$. Further, similar to the cascode transistor 105, the channel length of the cascode transistor 205 is set low (e.g., $L_{UNIT}$) in order to keep the overdrive voltage $V_{DSat}$ and area of the cascode transistor 205 low. However, in another embodiment, the channel length of the cascode transistor 205 can be set to a long length. In an embodiment, the source node of the cascode transistor 205 is connected to the drain node of the second current source transistor 201*b*, and the drain node of the cascode transistor 205 is connected to: (i) the source node of the first current mirror transistor 202*a* and (ii) the drain node of the second current mirror transistor 202*b*. Further, the gate node of the cascode transistor 205 receives a voltage $V_{PBC}$. The voltage $V_{PBC}$ is the $V_{GS}$ of the cascode transistor 205. In an embodiment, the voltage $V_{PBC}$ is less than the voltage difference between $V_{PB}$ and $V_{1B}$. In an embodiment, the cascode transistor 205 acts as a gain amplifier. Specifically, the cascode transistor 205 amplifies the low output impedance at the drain node of the second current source transistor 201*b*, resulting in a higher output impedance. Therefore, as the voltage $V_{1B}$ moves (e.g., due to noise, etc.) at the drain node of the cascode transistor 205, the voltage at the source node of the cascode transistor 205 (e.g., $V_3$) only has to move a small amount to compensate for the voltage movement of $V_{1B}$. Further, the cascode transistor 205 operates in the saturated region (e.g., $V_{DSat}>V_{GS}-V_T$). Therefore, the current going through the cascode transistor 205 (e.g., the input current $I_{IN2B}$) will be independent of the $V_{DS}$ across the cascode transistor 205. As such, the voltage $V_{PBC}$ at the gate node of the cascode transistor 205 does not have to move very much in order compensate for the movement of the voltage $V_{1B}$, and, therefore, any changes in the $V_{DS}$ of the cascode transistor 205, thereby isolating the $V_{DS}$ of the current source transistor 201*b* from changes at $V_{1B}$ as well as $V_{DD}$. Further, with a constant $V_{DS}$ across the current source transistor 201*b*, the input current $I_{IN2B}$ will also remain fixed. As such, the output current $I_{OUT2}$, which is meant to be a ratio of the sum of the input currents $I_{IN2A}$ and $I_{IN2B}$ (e.g., $K\times(I_{IN2A}+I_{IN2B})$), will also be maintained with some consistency. Further, because the current mirror 200 will be less sensitive to noise emanating from the power supply $V_{DD}$, it is also associated with a higher PSRR than the current mirror 200 in FIG. 2. In another embodiment, at least one additional cascode transistor can be connected in series with the cascode transistor 205.

In the foregoing Description of Embodiments, various features may be grouped together in a single embodiment for purposes of streamlining the disclosure. This method of disclosure is not to be interpreted as reflecting an intention that the claims require more features than are expressly recited in each claim. Rather, as the following claims reflect, inventive aspects lie in less than all features of a single foregoing disclosed embodiment. Thus, the following claims are hereby incorporated into this Description of the Embodiments, with each claim standing on its own as a separate embodiment of the invention.

Moreover, it will be apparent to those skilled in the art from consideration of the specification and practice of the present disclosure that various modifications and variations can be made to the disclosed systems without departing from the scope of the disclosure, as claimed. Thus, it is intended that the specification and examples be considered as exemplary only, with a true scope of the present disclosure being indicated by the following claims and their equivalents.

What is claimed is:

1. A current mirror system, comprising:

a first current source transistor, wherein the first current source transistor includes a channel width of 1 $W_{UNIT}$, wherein the $W_{UNIT}$ corresponds to a channel width of a unit transistor;

a second current source transistor, wherein the second current source transistor includes a channel width of $(N-1)\times W_{UNIT}$, wherein N is an integer that corresponds to a desired width of a current source transistor;

a first current mirror transistor, wherein the first current mirror transistor includes a channel width of $(M)\times W_{UNIT}$ and a channel length of $(N)\times L_{UNIT}$, wherein the $L_{UNIT}$ corresponds to a channel length of the unit transistor, wherein M is an integer that corresponds to a desired width of a desired current mirror transistor;

a second current mirror transistor, wherein the second current mirror transistor includes a channel width of $(M)\times W_{UNIT}$ and a channel length of $(P-1)\times L_{UNIT}$, wherein P is an integer that corresponds to a desired length of the desired current mirror transistor; and an output current transistor, wherein the output current transistor includes a channel width of $K\times(M)\times W_{UNIT}$ and a channel length of $(P-1)\times L_{UNIT}$, wherein K is a current gain coefficient.

2. The current mirror system of claim 1, wherein (i) a gate node of each of the first and second current source transistors receives a first voltage and (ii) a gate node of each of the first and second current mirror transistors and the output current transistor receives a second voltage.

3. The current mirror system of claim 1, wherein (i) a source node of each of the first and second current source transistors is connected to a first power supply, (ii) a drain node of the first current source transistor is connected to a drain node of the first current mirror transistor, and (iii) a drain node of the second current source transistor is connected to (a) a source node of the first current mirror transistor and (b) a drain node of the second current mirror transistor.

4. The current mirror system of claim 1, wherein a drain node of the second current mirror transistor and a drain node of the output current transistor are connected to a second power supply.

5. The current mirror system of claim 1, wherein the first and second current mirror transistors are connected in series, wherein a source node of the first current mirror transistor is connected to a drain node of the second current mirror transistor.

6. The current mirror system of claim 1, wherein the first current source transistor generates a first current and the second current source transistor generates a second current, wherein the first current is (1/N) of a total generated current and the second current is ((N−1)/N) of the total generated current.

7. The current mirror system of claim 6, wherein (i) the first current flows through the first current mirror transistor and (ii) a sum of the first and second currents flows through the second current mirror transistor.

8. The current mirror system of claim 7, wherein a load generates an output current, wherein the ratio of the output current to the sum of the first and second currents is equivalent to K, wherein the output current flows through the output current transistor.

9. The current mirror system of claim 8, wherein the load is connected to the drain node of the output current transistor.

10. The current mirror system of claim 8, wherein the load is one of (i) a resistor and (ii) another current mirror.

11. The current mirror system of claim 1, further comprising:

at least one other output transistor, wherein the at least one other output transistor is connected in parallel with the output transistor.

12. The current mirror system of claim 1, wherein (i) the first and second current source transistors are PMOS transistors and (ii) the first and second current mirror transistors and the output transistor are NMOS transistors.

13. The current mirror system of claim 1, wherein (i) the first current mirror transistor includes (N) stacked transistors, (ii) the second current mirror transistor includes (P−1) stacked transistors, and (iii) the output current transistor includes (P) stacked transistors.

14. The current mirror system of claim 1, further comprising:

a cascode transistor, wherein the cascode transistor includes a channel width of $(N-1)\times W_{UNIT}$.

15. The current mirror system of claim 14, wherein (i) a gate node of the cascode transistor receives a third voltage, (ii) a source node of the cascode transistor is connected to a drain node of the second current source transistor, and (iii) a drain node of the cascode transistor is connected to (a) a source node of the first current mirror transistor and (b) a drain node of the second current mirror transistor.

16. The current mirror system of claim 14, wherein the cascode transistor is a PMOS transistor.

17. The current mirror system of claim 14, further comprising:

at least one other cascode transistor, wherein the at least one other cascode transistor is connected in series with the cascode transistor.

18. A current mirror system, comprising:

a first current source transistor, wherein the first current source transistor is configured to generate a first current that is (1/N) of a total generated current, wherein N is an integer greater than zero;

a second current source transistor, wherein the second current source transistor is configured to generate a second current that is ((N−1)/N) of the total generated current, wherein the first and second currents are different;

a first current mirror transistor, wherein the first current mirror transistor is configured to receive the first current;

a second current mirror transistor, wherein the second current mirror transistor is configured to receive a sum of the first and second currents; and an output current transistor, wherein the output current transistor is configured to receive an output current, wherein the output current is based on the sum of the first and second currents at the second current mirror transistor, wherein each of the second current mirror transistor and the output current transistor include a channel length of $(P-1)\times L_{UNIT}$, wherein P is an integer that corresponds to a desired length of a desired current mirror transistor and the $L_{UNIT}$ corresponds to a channel length of a unit transistor.

19. The current mirror system of claim 18, further comprising:

a load, wherein the load is configured to originate the output current.

20. The current mirror system of claim 18, further comprising:

a cascode transistor, wherein the cascode transistor is configured to receive the second current.

* * * * *